US005471287A

United States Patent [19]

Blair et al.

[11] Patent Number: 5,471,287

[45] Date of Patent: Nov. 28, 1995

[54] SYSTEM FOR REPLENISHING LIQUID ELECTROSTATIC DEVELOPER

[75] Inventors: David E. Blair, Charleston, W. Va.; William A. Houle, Flat Rock, N.C.; Gregg A. Lane, San Diego, Calif.; James R. Larson, Fairport, N.Y.; Kathryn A. Pearlstine, Wilmington, Del.

[73] Assignee: E.I. Du Pont de Nemours and Company, Wilmington, Del.

[21] Appl. No.: 237,804

[22] Filed: May 4, 1994

[51] Int. Cl.[6] ..... G06G 15/10; G06G 9/12

[52] U.S. Cl. ..... 355/256; 430/114; 430/115

[58] Field of Search ..... 355/256; 118/659; 430/112, 114, 115, 116, 117, 119

[56] References Cited

U.S. PATENT DOCUMENTS

| | | | |
|---|---|---|---|
| 4,707,429 | 11/1987 | Trout | 430/115 |
| 4,798,778 | 1/1989 | El-Sayed et al. | 430/115 |
| 4,799,452 | 1/1989 | Day | 118/647 |
| 4,860,050 | 8/1989 | Kurotori et al. | 355/256 |
| 5,017,451 | 5/1991 | Larson et al. | 430/114 X |
| 5,206,108 | 4/1993 | Felder et al. | 430/114 X |
| 5,345,296 | 9/1994 | Wellings | 355/256 |

*Primary Examiner*—A. T. Grimley
*Assistant Examiner*—Nestor R. Ramirez

[57] ABSTRACT

System for replenishing liquid developer in equipment, such as a printer, whereby the percent of toner solids is maintained at about 0.5 to 4% by weight based on the total weight of liquid developer, the system comprising at least one liquid toner concentrate vessel containing aggregates of thermoplastic resin particles, median particle size (volume weighted) greater than 15 μm, and with 90% of the particles (volume weighted) not less than 30 μm, composed of 50 to 100% by weight of particles and 0 to 50% by weight carrier liquid; a liquid vessel containing carrier liquid, means communicating each of said vessels with a dispersing vessel containing high shearing or high impact means wherein contents of the liquid toner concentrate vessel and the liquid vessel are supplied thereto and the resin particles are dispersed in the carrier liquid to form particles having a median particle size (volume weighted) of less than 15 μm, and with 90% of the particles (volume weighted) less than 30 μm in an amount of about 0.5 to 20% by weight of resin particles and about 99.5 to 80% by weight carrier liquid said dispersion being supplied and metered into the supply vessel containing original liquid developer to maintain the desired weight of solids. The system is useful in copying, proofing, etc., equipment, and the liquid developer is useful for making copies, proofs, lithographic printing plates and resists.

8 Claims, 4 Drawing Sheets

SYSTEM FOR REPLENISHING LIQUID ELECTROSTATIC DEVELOPER

TECHNICAL FIELD

This invention relates to a system for replenishing liquid electrostatic developer. More particularly this invention relates to a system for replenishing liquid electrostatic developer using means for high shearing or high impact.

BACKGROUND OF THE INVENTION

Liquid electrostatic developers having chargeable toner particles dispersed in an insulating nonpolar liquid are well known in the art and are used to develop latent electrostatic images. Ideally, such liquid developers should be replenishable in the particular equipment in which they are used since developer solids that are removed by the imaging process must be replaced in order to maintain image quality. Failure to replace the solids used will result in image defects, such as low print density.

In general, high solids concentration toners are used because relatively low concentrations (e.g., in the range of 10 to 15% by weight solids) result in greater liquid buildup in the equipment, which then must be removed and disposed of as hazardous waste. Thus, it is desirable to initially use a toner containing less liquid, and to maintain working strength by replenishing the developer from a separate source located within the equipment, thus minimizing the undesirable accumulation of carrier liquid in the equipment.

When toners are present in the liquid developer in more concentrated form, however, they become difficult to redisperse in the carrier. For example, aggregates may be formed. This can cause serious problems in the replenishment of the liquid developer in the equipment being used.

SUMMARY OF THE INVENTION

It has been found that the above disadvantages can be overcome and liquid developer replenished in the equipment by means of a system whereby aggregated toner that is present is reduced in size by high shear or high impact and the toner particles are dispersed in carrier liquid.

Accordingly, this invention provides a system for replenishing a liquid electrostatic developer present in a supply vessel, the liquid developer consisting essentially of (A) a nonpolar liquid having a Kauri-butanol value of less than 30, (B) thermoplastic resin particles having a median particle size (volume weighted) less than 15 μm, and with 90% of the particles (volume weighted) less than 30 μm, and (C) a charge director compound, the percent of solids in the developer being about 0.5 to 4% by weight based on the total weight of liquid developer; the system comprising (1) at least one liquid toner concentrate vessel containing aggregates of thermoplastic resin particles having a median particle size (volume weighted) greater than 15 μm and with 90% of the particles (volume weighted) not less than 30 μm, composed of 50 to 100% by weight of particles (B), 0 to 50% by weight of component (A) being present in the vessel;

(2) a liquid vessel containing component (A);

(3) means for supplying aggregates of thermoplastic resin particles from the liquid toner concentrate vessel to a dispersing vessel;

(4) means for supplying component (A) from the liquid vessel to a dispersing vessel;

(5) a dispersing vessel containing high shearing or high impact means, said vessel (i) receiving thermoplastic resin particles from liquid toner concentrate vessel and component (A) from a liquid vessel and (ii) dispersing the aggregates of the thermoplastic resin particles in component (A) to form resin particles having a median particle size (volume weighted) of less than 15 μm, with 90% of the particles (volume weighted) less than 30 μm, said dispersion containing about 0.5 to 20% by weight particles (B) and about 99.5 to 80% by weight component (A);

(6) means for supplying and metering the dispersion of thermoplastic resin particles from the dispersing vessel into said supply vessel containing the liquid developer to be replenished to maintain the concentration of solids in the liquid developer in the range of about 0.5 to 4% by weight based on the total weight of liquid developer.

DETAILED DESCRIPTION OF THE INVENTION

Figure 1:
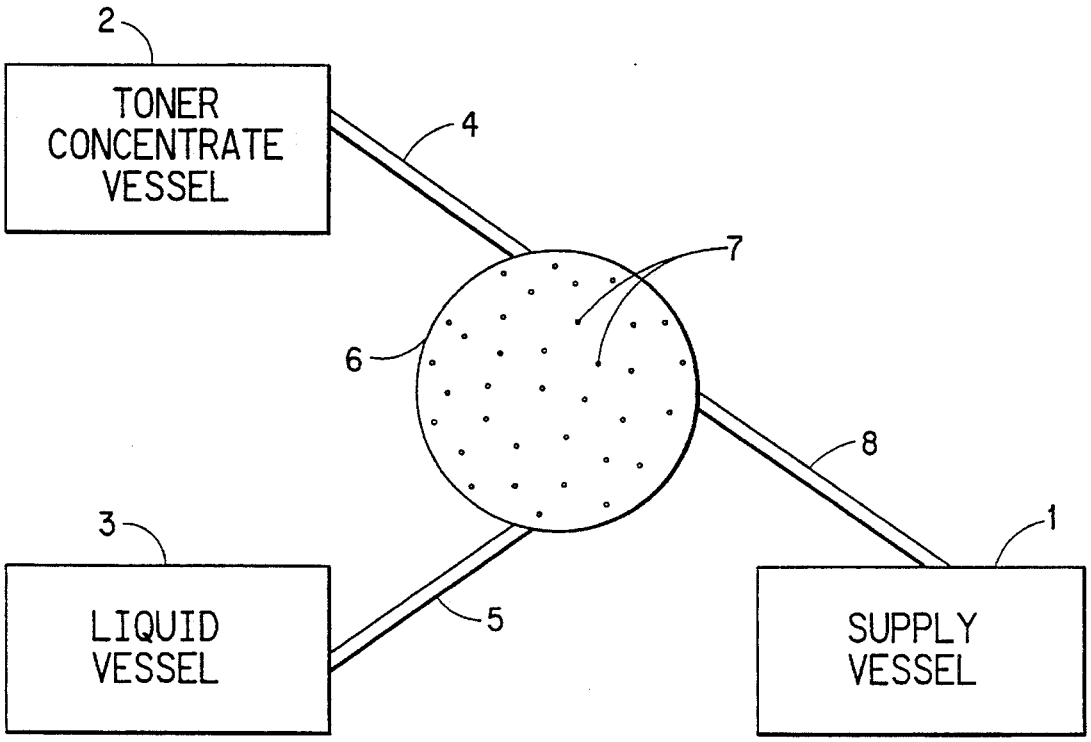
FIG. 1 is a schematic of a system wherein liquid electrostatic developer is replenished by means of supplied dispersed toner in accordance with the invention.

The replenishment system of this invention can be understood by referring to the drawing, wherein all illustrated components are present in a piece of equipment, such as a printer, not shown.

FIG. 1 illustrates an embodiment of the invention wherein supply vessel 1 contains a liquid developer consisting essentially of (A) a nonpolar carrier liquid having a Kauri-butanol value of less than 30, (B) thermoplastic resin particles (toner particles) having a median particle size (volume weighted) less than 15 μm, and with 90% of the particles (volume weighted) less than 30 μm which optionally may contain a dispersed colorant, and (C) a charge director compound, the percent of solids in the developer being about 0.5 to 4% by weight based on the total weight of liquid developer. "Consisting essentially of" means that the liquid electrostatic developer may contain unspecified components that do not prevent the advantage of the liquid developer from being realized. The replenishment system enables the concentration of solids in the liquid developer to be maintained in the range of about 0.5 to 4% by weight, based on the total weight of liquid developer, using liquid developer contained in supply vessel 1. The developer solids concentration is monitored by means known to those skilled in the art, such as a calibrated light attenuation sensor or the like contained within vessel 1. Vessel 1 also contains a float switch to maintain proper volume, and a developer conductivity sensor to maintain the proper concentration of charge director.

The ingredients for the liquid developer are obtained from at least one liquid toner concentrate vessel 2 that contains aggregates of thermoplastic resin particles having a median particle size (volume weighted) greater than 15 μm, with 90% of the particles (volume weighted) not less than 30 μm.

The concentrate is composed of 30 to 100% by weight of such particles and to 70% by weight nonpolar liquid (A). Vessel 3 contains liquid component (A). Means 4 and 5 respectively communicate with concentrate vessel 2 and liquid vessel 3 connecting said vessels with dispersing vessel 6 in order to supply vessel 6 with liquid toner concentrate from vessel 2 and non-polar liquid from vessel 3. Communicating means 4 and 5 can be pipes, tubes, conduits, or the like through which the toner concentrate and non-polar liquid are supplied and metered (by means not shown) into vessel 6. Metering devices can be solenoid metering pumps or other metering devices selected on the basis of the physical characteristics of the material being transported.

Dispersing vessel 6 contains means for high shearing or high impact, illustrated by particulate media 7, which effectively reduces the average size of the thermoplastic resin particles into the desired median particle size (volume weighted) of less than 15 μm, with 90% of the particles (volume weighted) less than 30 μm, in an amount of about 0.5 to 20% by weight particles (B) and about 99.5 to 80% by weight component (A). The terms "high shearing" or "high impact", as well as devices to accomplish high shear or high impact, are known to those skilled in the art, and are described in *Colloid Systems and Interfaces*, S. Ross and I. D. Morrison, John Wiley and sons, New York, N.Y., 1988, pp. 56–63 and elsewhere in the art.

High shearing or high impact is effected in dispersing vessel 6 by means of (1) Particulate media 7 which are particulate materials (e.g., spherical, cylindrical), composed of carbon steel (which is preferred), stainless steel, alumina, ceramic, zirconia, silica, sillimanite or the like. A typical diameter for the particulate media is in the range of 0.04 to 0.5 inch (1.0 to approx. 13 mm).

Figure 2:
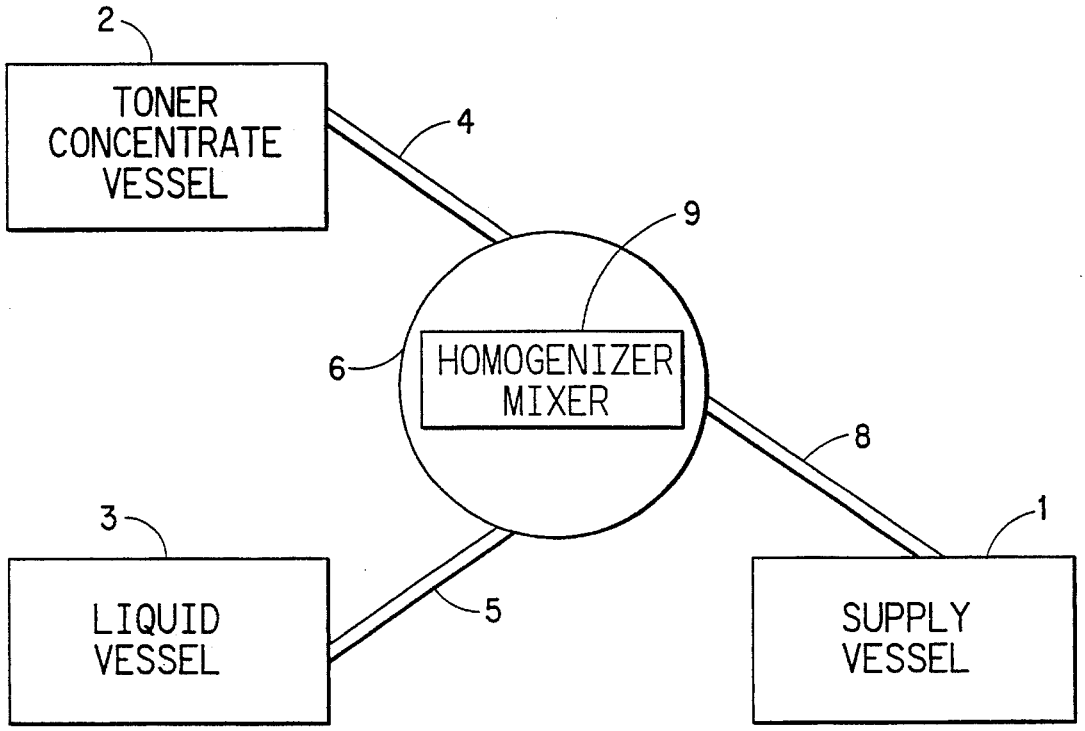
FIG. 2 is a schematic illustration of a second embodiment of the system in accordance with this invention.
Figure 3:
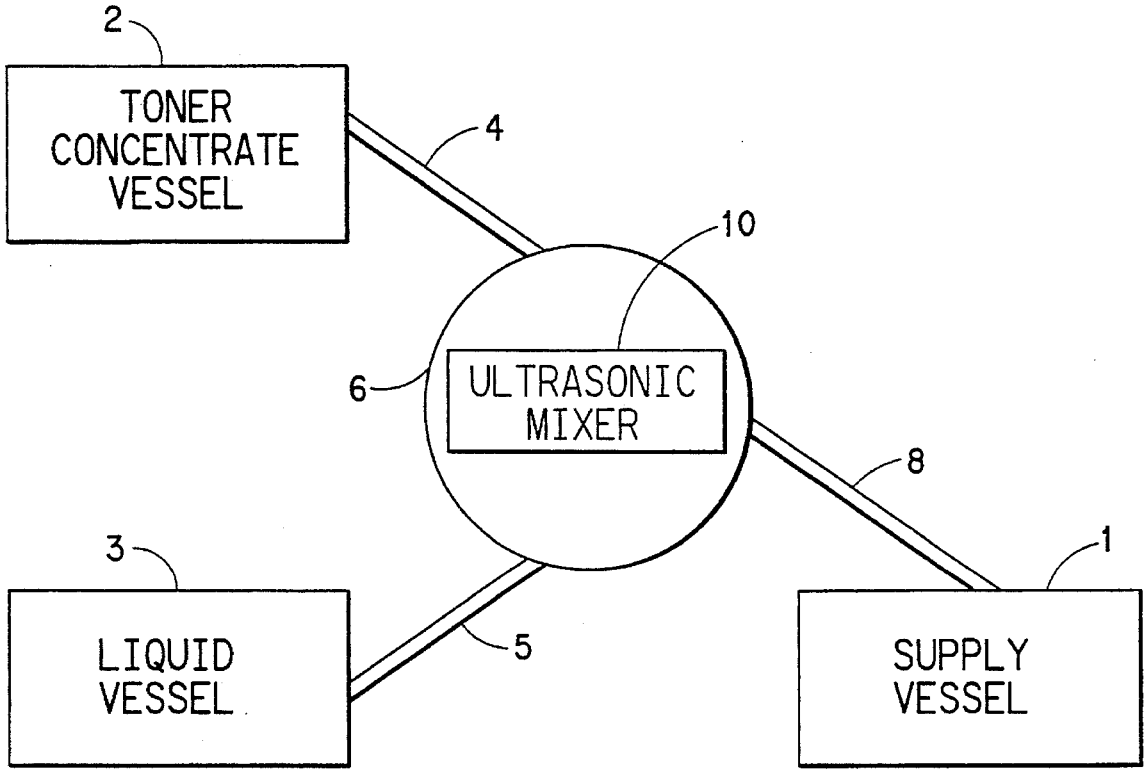
FIG. 3 is a schematic illustration of a third embodiment of the system in accordance with this invention.
Figure 4:
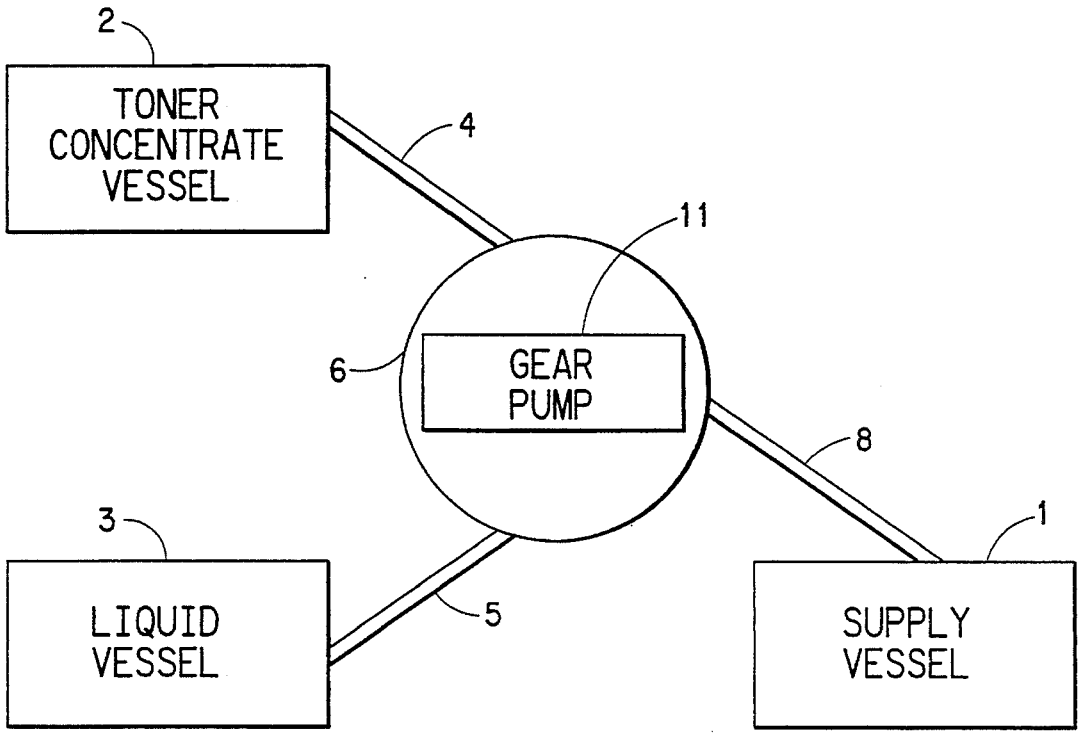
FIG. 4 is a schematic illustration of a fourth embodiment of the system in accordance with this invention.

(2) An homogenizer mixer as depicted in FIG. 2, such as those based on the rotostator principle where high shear, turbulence and cavitation forces are generated in the gap between a rotor and stator component. The rotor is typically a disc, plate, slotted discs or plates, multifaceted propeller, or series of perpendicular pins spinning at 1,000 to 30,000 rpm. The stator is a fixed cylindrical shaft that can range in size from 5 to 50 mm that circumscribes the rotor, typically slotted or cut with a sawtooth design;

(3) An ultrasonic mixer as depicted in FIG. 3 where a high frequency signal up to 20,000 Hz is converted to mechanical vibrations by, for example, metal tips or horns immersed in a liquid, causing cavitation forces;

(4) A gear pump as depicted in FIG. 4, e.g., by utilizing multiple passes through a gear pump having close gear tooth tolerances, such as a Micropump® series 120 gearhead driven by motor model #415 (Micropump, P. O. Box 4001, Concord Calif. 94524);

and other high shearing or high impact means known to those skilled in the art which provide a high rate of shear or high impact.

Means 8, communicating with dispersing vessel 6, connects said vessel with supply vessel 1 containing the liquid developer to be replenished. Communicating means 8 can be pipes, tubes, conduits, or the like, through which the dispersed toner particles are supplied and metered (by means not shown) into said vessel as required to maintain the developer solids concentration in vessel 1 as measured by the solids concentration sensor (not shown). The metering device can be solenoid metering pumps, metered feed screws, peristaltic pumps, piston pumps, diaphragm pumps, or other metering devices selected on the basis of the physical characteristics of the material being transported. Vessel 1 is supplied with non-polar liquid from vessel 3 by means not shown or optionally from a different vessel (not shown) and by means (not shown).

At least one of supply vessel 1, liquid toner concentrate vessel 2 or liquid vessel 3, can contain a charge director compound. The charge director compound can optionally be supplied from a vessel (not shown) and by means (not shown). The charge director, more fully described below, may be in an amount of 0.1 to 1000 milligrams per gram of developer solids, preferably 1 to 300 milligrams per gram of developer solids. The specific ingredients used to make up the composition of the liquid electrostatic developer are described more fully as follows.

The nonpolar liquids (A) typically are branched-chain aliphatic hydrocarbons and more particularly, Isopar®-G, Isopar®-H, Isopar®-K, Isopar®-L, Isopar®-M and Isopar®-V. These hydrocarbon liquids are narrow cuts of iso-paraffinic hydrocarbon fractions with extremely high levels of purity. For example, the boiling range of Isopar®-G is between 157° C. and 176° C., Isopar®-H between 176° C. and 191° C., Isopar®-K between 177° C. and 197° C., Isopar®-L between 188° C. and 206° C. and Isopar®-M between 207° C. and 254° C. and Isopar®-V between 254.4° C. and 329.4° C. Isopar®-L has a mid-boiling point of approximately 194° C. Isopar®-M has a flash point of 80° C. and an auto-ignition temperature of 338° C. Stringent manufacturing specifications limit impurities such as sulfur, acids, carboxyl, and chlorides to a few parts per million. They are substantially odorless, possessing only a very mild paraffinic odor. They have excellent odor stability and are all manufactured by the Exxon Corporation. High-purity normal paraffinic liquids, Norpar® 12, Norpar® 13 and Norpar® 15, Exxon Corporation, may be used. These hydrocarbon liquids have the following flash points and auto-ignition temperatures:

| Liquid | Flash Point (°C.) | Auto-Ignition Temp (°C.) |
|---|---|---|
| Norpar ® 12 | 69 | 204 |
| Norpar ® 13 | 93 | 210 |
| Norpar ® 15 | 118 | 210 |

All of the nonpolar liquids have an electrical volume resistivity in excess of $10^9$ ohm centimeters and a dielectric constant below 3.0. The vapor pressures at 25° C. are less than 10 Torr. Isopar®-G has a flash point, determined by the tag closed cup method, of 40° C., Isopar®-H has a flash point of 53° C. determined by ASTM D 56. Isopar®-L and Isopar®-M have flash points of 61° C., and 80° C., respectively, determined by the same method. While these are the preferred nonpolar liquids, the essential characteristics of all suitable nonpolar liquids are the electrical volume resistivity and the dielectric constant. In addition, a feature of the nonpolar liquids is a low Kauri-butanol value less than 30, preferably in the vicinity of 27 or 28, determined by ASTM D 1133.

The ratio of thermoplastic resin to nonpolar liquid is such that the combination of ingredients becomes fluid at the working temperature. The nonpolar liquid is present in an amount of 96% to 99.5% by weight, preferably 97 to 99% by weight, based on the total weight of liquid developer. The total weight of solids in the liquid developer is about 0.5 to 4%, preferably 1 to 3% by weight. The total weight of solids in the liquid developer is solely based on the resin, including any components dispersed therein, and any pigment component present.

Useful thermoplastic resins or polymers (B) include: ethylene vinyl acetate (EVA) copolymers (Elvax® resins, E. I. du Pont de Nemours and Company, Wilmington, Del.), copolymers of ethylene and an α,β-ethylenically unsaturated acid selected from the group consisting of acrylic acid and methacrylic acid, copolymers of ethylene (80 to 99.9%)/acrylic or methacrylic acid (20 to 0%)/alkyl ($C_1$ to $C_5$) ester of methacrylic or acrylic acid (0 to 20%), polyethylene, polystyrene, isotactic polypropylene (crystalline), ethylene ethyl acrylate series sold under the trademark Bakelite® DPD 6169, DPDA 6182 Natural and DTDA 9169 Natural by Union Carbide Corp., Stamford, Conn.; ethylene vinyl acetate resins, e.g., DQDA 6479 Natural and DQDA 6832 Natural 7 also sold by Union Carbide Corp.; Surlyn® ionomer resin by E. I. du Pont de Nemours and Company, Wilmington, Del., etc., or blends thereof, polyesters, polyvinyl toluene, polyamides, styrene/butadiene copolymers and epoxy resins. The synthesis of copolymers of ethylene and an α,β-ethylenically unsaturated acid of either acrylic acid or methacrylic acid is described in Rees U.S. Pat. No. 3,264,272, wherein the ethylene constituent is present in about 80 to 99.9% by weight and the acid component in about 20 to 0.1% by weight. A preferred copolymer is ethylene (90% by weight)/methacrylic acid (10% by weight). The acid numbers of the copolymers range from 1 to 120, preferably 54 to 90. Acid no. is milligrams potassium hydroxide required to neutralize 1 gram of polymer. The melt index (g/10 min) of 100 to 500 is determined by ASTM D 1238, Procedure A. Preferred copolymers of this type have an acid number of 66 and 60 and a melt index of 100 and 500 determined at 190° C., respectively.

Other resins include acrylic resins, such as a copolymer of acrylic or methacrylic acid (optional but preferred) and at least one alkyl ester of acrylic or methacrylic acid wherein alkyl is 1–20 carbon atoms, e.g., methyl acrylate (50–90%)/methacrylic acid (0–20%)/ethylhexyl methacrylate (10–50%) (Preferred is methylmethacrylate (67%)/methacrylic acid (3%)/ethylhexyl acrylate (30%)); and other acrylic resins including Elvacite® acrylic resins, E. I. du Pont de Nemours and Company, Wilmington, Del. or blends of resins, and modified resins disclosed in El-Sayed et al. U.S. Pat. No. 4,798,778.

In addition, the resins have the following preferred characteristics:

1. Are able to disperse the colorant, e.g., pigment, etc.
2. Are substantially insoluble in the dispersant liquid at temperatures below 40° C., so that the resin will not dissolve or solvate in storage,
3. Solvate (i.e., become swollen, gelatinous, or softened) at temperatures above 50° C.,
4. Are capable of being ground to form particles having a median particle size (volume weighted) less than 15 μm and with 90% of the particles (volume weighted) less than 30 μm, determined by Malvern 3600E described below, and
5. May be fused at temperatures in excess of 70° C. The Malvern 3600E Particle Sizer manufactured by Malvern, Southborough, Mass. uses laser diffraction light scattering of stirred samples to determine average particle sizes.

Suitable nonpolar liquid soluble charge director compounds (C), which are used in an amount of 0.25 to 1,500 mg/g, preferably 2.5 to 400 mg/g developer solids, include: anionic glyceride such as Emphos® D70-30C and Emphos® F27-85, two commercial products sold by Witco Corp., New York, N.Y.; which are sodium salts of phosphated mono- and diglycerides with unsaturated and saturated acid substituents, respectively, lecithin, Basic Barium Petronate®, Neutral Barium Petronate®, Calcium Petronate®, Neutral Calcium Petronate®, oil-soluble petroleum sulfonates, Witco Corp., New York, N.Y.; and metallic soaps such as aluminum tristearate, aluminum distearate; barium, calcium, lead and zinc stearates; cobalt, manganese, lead and zinc linoleates, aluminum, calcium and cobalt octoates; calcium and cobalt oleates; zinc palmitate; calcium, cobalt, manganese, iron, lead and zinc naphthenates; calcium, cobalt, manganese, lead and zinc resinates, etc.

Additional components that can be present in the electrostatic liquid developer are colorants, such as pigments or dyes and combinations thereof, which preferably are present to render the latent image visible, which is important for many applications. The colorant may be present in the amount of up to about 60 percent by weight based on the total weight of developer solids, preferably 0.01 to 30% by weight based on the total weight of developer solids. The amount of colorant may vary depending on the use of the developer. Examples of suitable pigments include:

Pigment List

| Pigment Brand Name | Manufacturer | Color Index Pigment |
|---|---|---|
| Permanent Yellow DHG | Hoechst | Yellow 12 |
| Permanent Yellow GR | Hoechst | Yellow 13 |
| Permanent Yellow G | Hoechst | Yellow 14 |
| Permanent Yellow NCG-71 | Hoechst | Yellow 16 |
| Permanent Yellow GG | Hoechst | Yellow 17 |
| Hansa Yellow RA | Hoechst | Yellow 73 |
| Hansa Brilliant Yellow 5GX-02 | Hoechst | Yellow 74 |
| Dalamar ® Yellow YT-858-D | Heubach | Yellow 74 |
| Hansa Yellow X | Hoechst | Yellow 75 |
| Novoperm ® Yellow HR | Hoechst | Yellow 83 |
| Chromophtal ® Yellow 3G | Ciba-Geigy | Yellow 93 |
| Chromophtal ® Yellow GR | Ciba-Geigy | Yellow 95 |
| Novoperm ® Yellow FGL | Hoechst | Yellow 97 |
| Hansa Brilliant Yellow 10GX | Hoechst | Yellow 98 |
| Lumogen ® Light Yellow | BASF | Yellow 110 |
| Permanent Yellow G3R-01 | Hoechst | Yellow 114 |
| Chromophtal ® Yellow 8G | Ciba-Geigy | Yellow 128 |
| Irgazin ® Yellow 5GT | Ciba-Geigy | Yellow 129 |
| Hostaperm ® Yellow H4G | Hoechst | Yellow 151 |
| Hostaperm ® Yellow H3G | Hoechst | Yellow 154 |
| L74-1357 Yellow | Sun Chem. | Yellow 14 |
| L75-1331 Yellow | Sun Chem. | Yellow 17 |
| L75-2337 Yellow | Sun Chem. | Yellow 83 |
| Hostaperm ® Orange GR | Hoechst | Orange 43 |
| Paliogen ® Orange | BASF | Orange 51 |
| Irgalite ® Rubine 4BL | Ciba-Geigy | Red 57:1 |
| Quindo ® Magenta | Mobay | Red 122 |
| Indofast ® Brilliant Scarlet | Mobay | Red 123 |
| Hostaperm ® Scarlet GO | Hoechst | Red 168 |
| Permanent Rubine F6B | Hoechst | Red 184 |
| Monastral ® Magenta | Ciba-Geigy | Red 202 |
| Monastral ® Scarlet | Ciba-Geigy | Red 207 |
| Heucophthal ® Blue G KBT 583D | Heubach, Inc. | |
| Heliogen ® Blue L 6901F | BASF | Blue 15:2 |
| Heliogen ® Blue NBD 7010 | BASF | Blue:3 |
| Heliogen ® Blue K 7090 | BASF | Blue 15:3 |
| Heliogen ® Blue L 7101F | BASF | Blue 15:4 |
| Paliogen ® Blue L 6470 | BASF | Blue 60 |
| Heliogen ® Green K 8683 | BASF | Green 7 |
| Heliogen ® Green L 9140 | BASF | Green 36 |
| Monastral ® Violet R | Ciba-Geigy | Violet 19 |
| Monastral ® Red B | Ciba-Geigy | Violet 19 |
| Quindo ® Red R6700 | Mobay | Violet 19 |
| Quindo ® Red R6713 | Mobay | |

-continued

Pigment List

| Pigment Brand Name | Manufacturer | Color Index Pigment |
|---|---|---|
| Indofast ® Violet | Mobay | Violet 23 |
| Monastral ® Violet Maroon B | Ciba-Geigy | Violet 42 |
| Sterling ® NS Black | Cabot | Black 7 |
| Sterling ® NSX 76 | Cabot | |
| Tipure ® R-101 | Du Pont | White 6 |

Other ingredients may be added to the electrostatic liquid developer, such as fine particle size oxides (e.g., silica, alumina, titania), preferably in the order of 0.5 μm or less dispersed in the resin. These oxides can be used alone or in combination with the colorant. Metal particles can also be added.

Another optional component of the electrostatic liquid developer is an adjuvant selected from the group consisting of polyhydroxy compound which contains at least 2 hydroxy groups, aminoalcohol compounds, polybutylene succinimide, metallic soaps, and aromatic hydrocarbon having a Kauri-butanol value of greater than 30. The adjuvants are generally used in an amount of 1 to 1000 mg/g, preferably 1 to 200 mg/g developer solids. Examples of the various above-described adjuvants include:

polyhydroxy compounds: ethylene glycol, 2,4,7,9 -tetramethyl-5-decyn-4,7-diol, poly(propylene glycol), pentaethylene glycol, tripropylene glycol, triethylene glycol, glycerol, pentaerythritol, glycerol-tri-12 hydroxystearate, ethylene glycol monohydroxystearate, propylene glycerol monohydroxystearate, etc., as described in Mitchell U.S. Pat. No. 4,734,352;

aminoalcohol compounds: triisopropanolamine, triethanolamine, ethanolamine, 3-amino-1-propanol, o-aminophenol, 5-amino-1-pentanol, tetra(2-hydroxyethyl)ethylenediamine, etc., described in Larson U.S. Pat. No. 4,702,985;

polybutylene/succinimide: OLOA®-1200 sold by Chevron Corp., analysis information appears in Kosel U.S. Pat. No. 3,900,412, column 20, lines 5 to 13; Amoco 575 having a number average molecular weight of about 600 (vapor pressure osmometry) made by reacting maleic anhydride with polybutene to give an alkenylsuccinic anhydride which in turn is reacted with a polyamine. Amoco 575 is 40 to 45% surfactant, 36% aromatic hydrocarbon, and the remainder oil, etc. These adjuvants are described in El-Sayed and Taggi U.S. Pat. No. 4,702,984;

metallic soap: aluminum tristearate; aluminum distearate; barium, calcium, lead and zinc stearates; cobalt, manganese, lead and zinc linoleates; aluminum, calcium and cobalt octoates; calcium and cobalt oleates; zinc palmitate; calcium cobalt, manganese, lead and zinc naphthenates; calcium, cobalt, manganese, lead and zinc resinates, etc. The metallic soap is dispersed in the thermoplastic resin and described in Trout, U.S. Pat. No. 4,707,429; and aromatic hydrocarbon: benzene, toluene, naphthalene, substituted benzene and naphthalene compounds, e.g., trimethylbenzene, xylene, dimethylethylbenzene, ethylmethylbenzene, propylbenzene, Aromatic 100 which is a mixture of $C_9$ and $C_{10}$ alkyl-substituted benzenes manufactured by Exxon Corp., etc., as described in Mitchell U.S. Pat. No. 4,631,244.

The resin particles of the developer may or may not be formed having a plurality of fibers integrally extending therefrom, but the presence of fibers extending from the toner particles is preferred. The term "fibers" as used herein means pigmented toner particles formed with fibers, tendrils, tentacles, threadlets, fibrils, ligaments, hairs, bristles, or the like. Illustration of such fibers can be found in Landa et al., U.S. Pat. No. 4,842,974.

The charged electrostatic liquid developer can be prepared by a variety of processes as described in U.S. Pat. No. 4,707,429, issued Nov. 17, 1987. For example, the thermoplastic resin and nonpolar liquid are placed into a suitable mixing or blending vessel, such as an attritor, heated ball mill, heated vibratory mill such as a Sweco Mill manufactured by Sweco Co., Los Angeles, Calif., equipped with particulate media, for dispersing and grinding, Ross double planetary mixer manufactured by Charles Ross and Son, Hauppauge, N.Y., etc., or a two roll heated mill (no particulate media necessary). Generally the resin, adjuvant if dispersed in the resin, nonpolar liquid and optional colorant are placed in the vessel prior to starting the dispersing step. Optionally the colorant can be added after homogenizing the resin and the nonpolar liquid. Polar additive, similar to that described in Mitchell, U.S. Pat. No. 4,631,244, can also be present in the vessel, e.g., up to 100% based on the weight of polar additive and nonpolar liquid. The dispersing step is generally accomplished at elevated temperature, i.e., the temperature of ingredients in the vessel being sufficient to plasticize and liquefy the resin but being below that at which the nonpolar liquid or polar additive, if present, degrades and the resin and/or colorant decomposes. A preferred temperature range is 80° to 120° C. Other temperatures outside this range may be suitable, however, depending on the particular ingredients used. The presence of the irregularly moving particulate media is preferred to prepare the dispersion of toner particles. Other stirring means can be used as well, however, to prepare dispersed toner particles of proper size, configuration and morphology.

After dispersing the ingredients in the vessel, with or without a polar additive present, until the desired dispersion is achieved, typically 1 hour with the mixture being fluid, the dispersion is cooled, e.g., in the range of 0° C. to 50° C. Cooling may be accomplished, for example, in the same vessel, such as the attritor, while simultaneously grinding with particulate media to prevent the formation of a gel or solid mass; without stirring to form a gel or solid mass, followed by shredding the gel or solid mass and grinding, e.g., by means of particulate media; or with stirring to form a viscous mixture and grinding by means of particulate media. Additional liquid may be added at any step during the preparation of the liquid electrostatic toners to facilitate grinding or to dilute the toner to the appropriate % solids needed for toning. Additional liquid means nonpolar liquid, polar liquid or combinations thereof. Cooling is accomplished by circulating cold water or a cooling material through an external cooling jacket adjacent the dispersing apparatus, or by permitting the dispersion to cool to ambient temperature. The resin precipitates out of the dispersant during the cooling. Toner particles of median particle size (volume weighted) of less than 15 μm, and with 90% of the particles (volume weighted) less than 30 μm as determined by a Malvern 3600E Particle Sizer or other comparable apparatus, are formed by grinding for a relatively short period of time.

After cooling and separating the dispersion of toner particles from the particulate media, if present, by means known to those skilled in the art, it is possible to reduce the concentration of the toner particles in the dispersion, impart an electrostatic charge of predetermined polarity to the toner particles, or a combination of these variations. One or more ionic or zwitterionic charge director compounds (C), of the type set out above, can be added to impart a charge. The addition may occur at any time during the process; preferably at the end of the process after the particulate media, if used, are removed and the concentration of toner particles is accomplished. If a diluting nonpolar liquid is also added, the charge director compound can be added prior to, concurrently with, or subsequent thereto. If an additional adjuvant compound of a type described above has not been previously added in the preparation of the developer, it can be added prior to or subsequent to the developer being charged.

Other process embodiments for preparing the electrostatic liquid developer include:

(A) dispersing a thermoplastic resin, and optionally a colorant and/or adjuvant in the absence of a nonpolar liquid having a Kauri-butanol value of less than 30 to form a solid mass.

(B) shredding the solid mass, (C) grinding the shredded solid mass by means of particulate media in the presence of a liquid selected from the group consisting of a polar liquid having a Kauri-butanol value of at least 30, a nonpolar liquid having a Kauri-butanol value of less than 30, and combinations thereof, (D) separating the dispersion of toner particles having an average by area particle size of less than 10 μm from the particulate media, and (E) adding to the dispersion a nonpolar soluble charge director compound;

or (A) dispersing a thermoplastic resin, and optionally a colorant and/or adjuvant in the absence of a nonpolar liquid having a Kauri-butanol value of less than 30 to form a solid mass.

(B) shredding the solid mass, (C) redispersing the shredded solid mass at an elevated temperature in a vessel in the presence of a nonpolar liquid having a Kauri-butanol value of less than 30, and optionally a colorant, while maintaining the temperature in the vessel at a temperature sufficient to plasticize and liquify the resin but below that at which the nonpolar liquid degrades and the resin and/or colorant decomposes, (D) cooling the dispersion, either (1) without stirring to form a gel or solid mass, followed by shredding the gel or solid mass and grinding by means of particulate media with or without the presence of additional liquid;

(2) with stirring to form a viscous mixture and grinding by means of particulate media with or without the presence of additional liquid; or (3) while grinding by means of particulate media to prevent the formation of a gel or solid mass with or without the presence of additional liquid;

(E) separating the dispersion of toner particles having an average by area particle size of less than 10 μm from the particulate media, and (F) adding to the dispersion a nonpolar soluble charge director compound.

The liquid electrostatic developer having a percent of solids based on the weight of the total developer of about 0.5 to about 4% by weight is present initially in the equipment. The system of the invention described above readily enables the percentage of solids in the liquid developer within such equipment to be maintained at the desired amount.

INDUSTRIAL APPLICABILITY

The system of this invention is useful in any equipment wherein liquid electrostatic developers are used to maintain the concentration of toner solids dispersed in the liquid developer at a desired amount without the need to dispose of excess carrier liquid. Such equipment is useful in copying, e.g., making office copies of black and white as well as various colors; or color proofing, e.g., a reproduction of an image using the standard colors: yellow, cyan, magenta together with black as desired; highlight color copying, e.g., copying of two colors usually black and a highlight color for letterheads, underlining, etc. Other uses for the liquid developers include: digital color proofing, lithographic printing plates, and resists.

EXAMPLES

The following controls and examples wherein the parts and percentages are by weight illustrate, but do not limit, the invention. In the Examples the melt indices are determined by ASTM D 1238, Procedure A.

Control 1

A magenta toner was prepared by adding 253.4 g of a copolymer of ethylene (90%) and methacrylic acid (10%), melt index at 190° C. is 500, Acid No. is 60, 64.2 g of a magenta pigment, Quindo Red R6700, Mobay Corporation, Dyes and Pigments Organics Division, Pittsburgh, Pa., 3.21 grams of aluminum tristearate, and 1284 g of Isopar®-L to a Union Process is attritor, Union Process Co., Akron, Ohio, charged with 0.1857 inch (4.76 mm) diameter carbon steel balls. The mixture was milled at 90° C. for 1 hour, cooled to 20° C. an additional 535 g of Isopar®-L were added, and milled for another 4 hours. An additional 535 grams of Isopar® L were added to bring the percent solids to 12%. The particle size was 6.5 μm V(50) and 13.3 μm V(90) measured with a Malvern 3600E particle size analyzer. The 12% toner was concentrated to about 30% solids by vacuum filtering. The % solids was increased to 63% by pressure blotting 40–50 g portions of this toner for 30 sec between absorbent paper at 10 metric tons using a Dake Elec-Draulic model 5-075 hydraulic press, Dake Corp., Grand Haven, Mich. The pressed toner aggregates were combined and pulverized by brushing through a #25 (707 μm/0.0278 inch) sieve using a bristle brush.

Control 2

A black toner was prepared by adding 288.9 g of a copolymer of ethylene (90%) and methacrylic acid (10%), melt index at 190° C. is 500, Acid No. is 60, 32.1 g of a black pigment, Sterling NS, Cabot Corp, Boston, Mass., and 1284 g of Isopar®-L to a Union Process 1S attritor, Union Process Co., Akron, Ohio, charged with 0.1857 inch (4.76 mm) diameter carbon steel balls. The mixture was milled at 90° C. for 1 hour, cooled to 20° C. an additional 535 g of Isopar® L were added, and milled for another 2 hours. An additional 535 grams of Isopar®-L were added to bring the percent solids to 12%. The particle size was 10.9 μm, V(50) and 20.7 μm V(90) measured with a Malvern 3600E particle size analyzer. The 12% toner was further concentrated by filtering in a Buchner funnel to a thick paste and air drying to 54% solids.

Control 3

A black toner was prepared by adding 256.8 g of a terpolymer of methyl methacrylate (67%), methacrylic acid (3%), and ethylhexylacrylate (30%), Acid No. 13, 64.2 g of a black pigment, Sterling NS, Cabot Corp, Boston, Mass., and 1284 g of Isopar®-L to a Union Process 1S attritor, Union Process Co., Akron, Ohio, charged with 0.1857 inch (4.76 mm) diameter carbon steel balls. The mixture was milled at 90° C. for 1.25 hours, cooled to 20° C., an additional 535 g of Isopar®-L were added, and milled for another 4 hours. An additional 535 grams of Isopar®-L were added to bring the percent solids to 12%. The particle size was 9.0 μm V(50) and 17.0 μm V(90) measured with a Malvern 3600E particle size analyzer. The 12% toner was further concentrated by filtering in a Buchner funnel to a thick paste and air drying to 51% solids.

EXAMPLE 1

Three grams of the black toner prepared as described in Control 2 were mixed with 147 grams of Isopar®-L and charged with a 10% solution of Basic Barium Petronate® (BBP), Witco Corp, New York, N.Y., at 30 mg of BBP per gram of toner solids to give a 1% solids mixture. The toner settled immediately in large clumps which were in excess of 100 μm and were visible to the eye. This mixture was homogenized on an Omni Homogenizer Model 17505 with a 15401 generator at top speed. Samples were taken at the times indicated and the particle size was measured on a Malvern 3600E Particle Size Analyzer. An acceptable particle size distribution was obtained within 3 minutes.

| Time (min.) | V(50) μm | V(90) μm |
|---|---|---|
| 1 | 13.0 | 36.4 |
| 3 | 11.8 | 28.3 |
| 6 | 11.4 | 27 |
| 9 | 11.0 | 24.4 |

EXAMPLE 2

Three grams of the black toner prepared as described in Control 3 were mixed with 147 grams of Isopar®-L and charged with a 10% solution of Basic Barium Petronate® (BBP), Witco Corp, New York, N.Y., at 30 mg of BBP per gram of toner solids to give a 10% solids mixture. The toner settled immediately in large clumps which were in excess of 100 μm and were visible to the eye. This mixture was homogenized on an Omni Homogenizer Model 17505 with a 15401 generator at top speed. Samples were taken at the times indicated and the particle size was measured on a Malvern 3600E Particle Size Analyzer. A useful particle size distribution was obtained within 1 minute.

| Time (min.) | V(50) μm | V(90) μm |
|---|---|---|
| 1 | 8.1 | 18.0 |
| 3 | 7.9 | 16.3 |
| 6 | 7.3 | 14.7 |
| 9 | 7.3 | 14.4 |

EXAMPLE 3

Four samples containing 3.6 grams of magenta toner prepared as described in Control 1 were mixed with 146 grams of Isopar®-L and charged with a 10% solution of Basic Barium Petronate® (BBP), Witco Corp, New York, N.Y., at 30 mg of BBP per gram of toner solids. The toner settled immediately in large clumps which were in excess of 100 μm and were visible to the eye. These samples were dispersed in an Omni Homogenizer 17505 with a 15401 generator at variable speeds and variable time. Particle sizes were determined using the Malvern 3600E particle size analyzer. Results are given below. Conclusion: speed setting 7 for 9 minutes or speed setting 10 for 3 minutes is the minimum condition for desired redispersion.

| Sample | Speed Setting | Time (Min) | V(50) μm | V(90) μm |
|---|---|---|---|---|
| 1 | 3 | 1 | 34.7 | 91.2 |
| 1 | 3 | 3 | 17.4 | 81.0 |
| 1 | 3 | 9 | 37.7 | 90.8 |
| 2 | 7 | 1 | 10.2 | 58.9 |
| 2 | 7 | 3 | 7.7 | 35.3 |
| 2 | 7 | 9 | 6.6 | 14.9 |
| 3 | 10 | 1 | 8.4 | 35.8 |
| 3 | 10 | 3 | 7.4 | 22.7 |
| 3 | 10 | 9 | 6.2 | 12.1 |
| 4 | 7 | 1 | 8.9 | 37.5 |
| 4 | 7 | 3 | 7.6 | 27.7 |
| 4 | 7 | 9 | 6.6 | 15.5 |

EXAMPLE 4

Twenty-three grams of the magenta toner prepared as described in Control 1 were mixed with 127 grams of Isopar®-L and charged with a 10% solution of Basic Barium Petronate® (BBP), Witco Corp, New York, N.Y., at 30 mg of BBP per gram of toner solids to give a 10% solids mixture. The toner settled immediately in large clumps which were in excess of 100 μm and were visible to the eye. This mixture was homogenized on an Omni Homogenizer Model 17505 with a 15401 generator at top speed. Samples were taken at the times indicated and the particle size was measured on a Malvern 3600E Particle Size Analyzer. An acceptable particle size distribution was obtained within 3 minutes.

| Time (min.) | V(50) μm | V(90) μm |
|---|---|---|
| 1 | 9.6 | 60.6 |
| 3 | 6.3 | 19.5 |
| 6 | 5.9 | 16.5 |
| 9 | 5.7 | 13.7 |

EXAMPLE 5

A mixture was prepared containing 59.5 grams of magenta toner prepared as described in Control 1 and 2440.5 grams of Isopar®-L, and charged with a 10% solution of Basic Barium Petronate® (BBP), Witco Corp, New York, N.Y., at 30 mg of BBP per gram of toner solids to give a 1.5% solids mixture. The toner settled immediately in large clumps which were in excess of 100 μm and were visible to the eye. This mixture was ground at 253 rpm in a Union Process 1S Attritor, Union Process Co., Akron, Ohio, charged with 0.1857 inch (4.76 mm) diameter carbon steel balls. Small samples were taken at the times indicated and the particle size was measured on a Malvern 3600E Particle Size Analyzer. An acceptable particle size was obtained within 1 minute.

| Time (min.) | V(50) μm | V(90) μm |
|---|---|---|
| 1 | 9.4 | 29.2 |
| 2 | 8.6 | 25.3 |
| 5 | 7.7 | 19.1 |
| 15 | 6.5 | 14.5 |
| 30 | 6.2 | 12.2 |
| 60 | 5.4 | 10.2 |

EXAMPLE 6

Three samples containing three grams of the magenta toner prepared as described in Control 1 were mixed with 147 grams of Isopar®-L and charged with a 10% solution of Basic Barium Petronate® (BBP), Witco Corp, New York, N.Y., at 30 mg of BBP per gram of toner solids to give a 1% solids mixture. The toner settled immediately in large clumps which were in excess of 100 μm and were visible to the eye. One other toner sample was placed in an ultrasonic cleaning bath, Branson Model 5200, manufactured by Branson Cleaning Equipment Co., Shelton, Conn. and samples were taken at the times indicated. Two other samples were run on an ultrasonic homogenizer (Heat Systems—Ultrasonics Inc., Model W380 power supply, Model C3 ultrasonic converter probe) run on a 1 second cycle time, 50% duty setting. One sample was run at a power setting of 3, a second sample was run at a power setting of 5. The ultrasonic probe run at the higher power setting achieved an acceptable particle size distribution in 3 minutes. Using the lower power setting with the probe, or milder ultrasonic conditions in the bath did not reduce the particle size as effectively.

| Time (min.) | V(50) μm | V(90) μm |
|---|---|---|
| | Ultrasonic Probe Setting 5 | |
| 1 | 9.5 | 75.0 |
| 3 | 5.5 | 20.5 |
| 6 | 5.0 | 9.1 |
| 9 | 4.9 | 8.7 |
| | Ultrasonic Probe Setting 3 | |
| 1 | 22.6 | 88.8 |
| 3 | 11.2 | 80.0 |
| 6 | 6.9 | 38.4 |
| 9 | 6.6 | 31.0 |
| | Ultrasonic Bath | |
| 1 | 11.9 | 62.1 |
| 3 | 7.6 | 24.8 |
| 6 | 6.8 | 17.9 |
| 9 | 6.5 | 14.5 |

EXAMPLE 7

Seven and a half grams of the magenta toner prepared as described in Control 1 were mixed with 492.5 grams of Isopar®-L and charged with a 10% solution of Basic Barium Petronate® (BBP), Witco Corp, New York, N.Y., at 30 mg of BBP per gram of toner solids to give a 1.5% solids mixture. This toner was circulated through a model 000-415 Micropump® (P/N 81406 motor and P/N 81110 gear head) gear pump, manufactured by Micropump, Concord, Calif., at 80 ml/sec. The liquid was kept at room temperature by cooling the container holding the toner in an ice bath. Samples were taken at the times indicated and the particle size was measured on a Malvern 3600E Particle Size Analyzer. A useful particle size distribution was obtained within 10 minutes. Results are shown in the table below.

| Time (min.) | V(50) μm | V(90) μm |
|---|---|---|
| 10 | 7.3 | 27.1 |
| 20 | 6.5 | 17.5 |
| 40 | 6.0 | 12.9 |
| 60 | 5.8 | 11.9 |
| 120 | 5.2 | 9.2 |
| 240 | 4.7 | 7.9 |

EXAMPLE 8

Fifty grams of the magenta toner prepared as described in Control 1 were mixed with 450 grams of Isopar®-L and charged with a 10% solution of Basic Barium Petronate® (BBP), Witco Corp, New York, N.Y., at 30 mg of BBP per gram of toner solids to give a 10% solids mixture. This toner was circulated through a model 000-415 Micropump® (P/N 81406 motor and P/N 81110 gear head) gear pump at 80 ml/sec. The liquid was kept at room temperature by cooling the container holding the toner in an ice bath. Samples were taken at the times indicated and the particle size was measured on a Malvern 3600E Particle Size Analyzer. A useful particle size distribution was obtained in less than 5 minutes. By working with a mixture containing a higher % solids, a larger quantity of toner could be dispersed in less time. Results are shown in the table below.

| Time (min.) | V(50) μm | V(90) μm |
|---|---|---|
| 5 | 5.5 | 11.5 |
| 10 | 5.7 | 10.8 |
| 15 | 5.7 | 10.3 |
| 20 | 5.6 | 9.9 |
| 25 | 5.4 | 9.5 |
| 30 | 5.6 | 9.6 |

Having described the invention, we claim the following and their equivalents.

What is claimed is:

1. A system for replenishing a liquid electrostatic developer present in a supply vessel, the liquid developer consisting essentially of (A) a nonpolar liquid having a Kauri-butanol value of less than 30, (B) thermoplastic resin particles having a median particle size (volume weighted) less than 15 μm, and with 90% of the particles (volume weighted) less than 30 μm, and (C) a charge director compound, the percent of solids in the developer being about 0.5 to 4% by weight based on the total weight of liquid developer; the system comprising at least one liquid toner concentrate vessel containing aggregates of thermoplastic resin particles having a median particle size (volume weighted) greater than 15 μm and with 90% of the particles (volume weighted) not less than 30 μm composed of 50 to 100% by weight of particles (B), 0 to 50% by weight of component (A) being present in the vessel, a liquid vessel containing component (A), means for supplying aggregates of thermoplastic resin particles from the liquid toner concentrate vessel to a dispersing vessel, means for supplying component (A) from the liquid vessel to the dispersing vessel, the dispersing vessel containing high shearing or high impact means, said vessel receiving thermoplastic resin particles from liquid toner concentrate vessel and component (A) from the liquid vessel and dispersing the aggregates of the thermoplastic resin particles in component (A) to form resin particles having a median particle size (volume weighted) of less than 15 μm, with 90% of the particles (volume weighted) less than 30 μm, said dispersion containing about 0.5 to 20% by weight particles (B) and about 99.5 to 80% by weight component (A), means for supplying and metering the dispersion of thermoplastic resin particles from the dispersing vessel into a supply vessel containing the liquid developer to be replenished to maintain the concentration of solids in the liquid developer in the range of about 0.5 to 4% by weight based on the total weight of liquid developer.

2. A system according to claim 1 wherein the high shearing or high impact means in the dispersing vessel is selected from the group consisting of particulate media, homogenizer mixer, ultrasonic mixer and gear pump.

3. A system according to claim 2 wherein the high shearing or high impact means is particulate media.

4. A system according to claim 2 wherein the high shearing or high impact means is a homogenizer mixer.

5. A system according to claim 2 wherein the high shearing or high impact means is an ultrasonic mixer.

6. A system according to claim 2 wherein the high shearing or high impact means is a gear pump.

7. A system according to claim 1 wherein the charge director compound is added to or present in at least one of the liquid toner concentrate vessel or liquid vessel or the supply vessel originally containing the liquid electrostatic developer.

8. A system according to claim 7 wherein the charge director compound is present in the supply vessel containing the liquid developer to be replenished.

* * * * *